US006620240B2

(12) United States Patent
Choi et al.

(10) Patent No.: US 6,620,240 B2
(45) Date of Patent: Sep. 16, 2003

(54) SHEET COATING APPARATUS

(75) Inventors: Sam-seuk Choi, Suwon (KR); Gyeong-ho Park, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 56 days.

(21) Appl. No.: 09/725,884

(22) Filed: Nov. 30, 2000

(65) Prior Publication Data

US 2001/0017104 A1 Aug. 30, 2001

(30) Foreign Application Priority Data

Feb. 24, 2000 (KR) ..... 2000-9093

(51) Int. Cl.[7] ..... B05C 1/08

(52) U.S. Cl. ..... 118/249; 118/259; 118/261; 118/262; 118/224; 118/227

(58) Field of Search ..... 118/224–226, 227, 118/249, 259, 261, 262, 112, 118, 123, DIG. 1; 427/428, 208, 209; 101/210, 365

(56) References Cited

U.S. PATENT DOCUMENTS 1,846,856 A * 2/1932 Francis ..... 118/226
3,379,171 A * 4/1968 Cordingly et al. ..... 118/211
3,405,006 A * 10/1968 Follrath ..... 118/115
3,885,518 A * 5/1975 Varni ..... 118/673
4,344,379 A * 8/1982 Roberts ..... 118/212
4,351,264 A * 9/1982 Flaum et al. ..... 101/351.8
4,774,107 A * 9/1988 von Kwiatkowski et al. ..... 118/216
5,516,365 A * 5/1996 Sandberg et al. ..... 118/118
5,633,045 A * 5/1997 Smith et al. ..... 427/428
6,068,701 A * 5/2000 Kohler et al. ..... 118/119

FOREIGN PATENT DOCUMENTS

JP 37-24943 9/1962
JP 11-033452 2/1999

* cited by examiner

*Primary Examiner*—Laura Edwards
(74) *Attorney, Agent, or Firm*—Sughrue Mion, PLLC

(57) ABSTRACT

A sheet coating apparatus for coating a coating liquid on a sheet traveling along a predetermined transfer path, including a storage tank in which the coating liquid is contained, a coating roller which is in contact with the sheet and which is rotatably installed on the transfer line, for coating the coating liquid supplied from the storage tank on the surface of the sheet, and a coated amount regulating mechanism which is securely pressed against the surface of the coating roller which regulates the amount of the coating liquid coated on the sheet by squeegeeing the coating liquid sticking on the surface of the coating roller. The sheet coating apparatus can prevent excess coating liquid from being coated on a sheet by regulating the amount of the coating liquid coated on the sheet, thereby attaining uniform coating.

6 Claims, 5 Drawing Sheets

SHEET COATING APPARATUS

BACKGROUND OF THE INVENTION

1. Field of the Invention

The present invention relates to a sheet coating apparatus for applying a predetermined coating liquid onto a sheet.

2. Description of the Related Art

In a liquid electrophotographic printer, e.g., a laser printer, in order to prevent a printed image from blotting on paper and to improve the resolution of an image, there has been proposed a coating apparatus for applying a coating liquid such as wax after a printing operation. However, the conventional coating apparatus, as shown in FIG. 1, is configured such that a coating roller 10 and a backup roller 20 are rotatably installed along the traveling path through which a sheet 1 passes, and the coating roller 10 is partially immersed in a storage tank 30 containing liquid wax W. Accordingly, the wax W that sticks to the coating roller 10 is coated onto the printed surface of the sheet 1 passing between the coating roller 10 and the backup roller 20.

However, in the above-described coating system, since the wax W moving upward along the surface of the coating roller 10 according to rotation thereof is coated onto the sheet 1 without some means of limiting the amount of the wax W adhering to the coating roller 10, it is not possible to regulate the amount of the coated wax. Thus, the amount of the coated wax is nonuniform and excess wax is likely to be coated in places, which results in increased consumption of a coating liquid. Therefore, a coating apparatus which can regulate the coated amount of a coating liquid is required.

SUMMARY OF THE INVENTION

To solve the above problems, it is an object of the present invention to provide an improved sheet coating apparatus which can uniformly regulate the amount of a coating liquid coated onto a sheet.

Accordingly, to achieve the above object, there is provided a sheet coating apparatus for coating a coating liquid on a sheet traveling along a predetermined transfer path, including a storage tank in which the coating liquid is contained, a coating roller which is in contact with the sheet and which is rotatably installed on the transfer path, for coating the coating liquid supplied from the storage tank on the surface of the sheet, and a coated amount regulating mechanism which is securely pressed against the surface of the coating roller, and which regulates the amount of the coating liquid coated on the sheet by squeegeeing the coating liquid sticking on the surface of the coating roller.

BRIEF DESCRIPTION OF THE DRAWINGS

The above object and advantages of the present invention will become more apparent by describing in detail a preferred embodiment thereof with reference to the attached drawings, in which.

DETAILED DESCRIPTION OF THE PREFERRED EMBODIMENTS

The coating apparatus described in the present invention can be used for coating general sheet-type materials, but the following embodiments relate to the case of coating a sheet having an image printed thereon in a printer.

Figure 1:
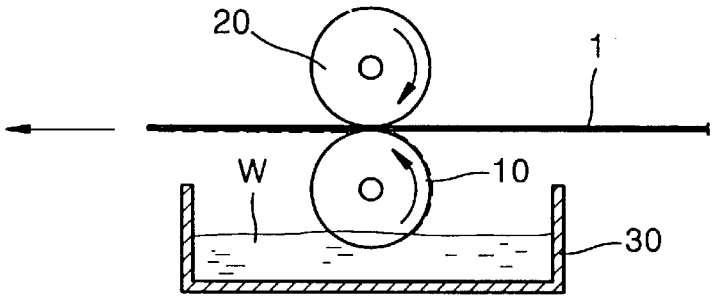
FIG.1 (PRIOR ART)
FIG. 1 is a schematic diagram illustrating a conventional sheet coating apparatus.
Figure 3:
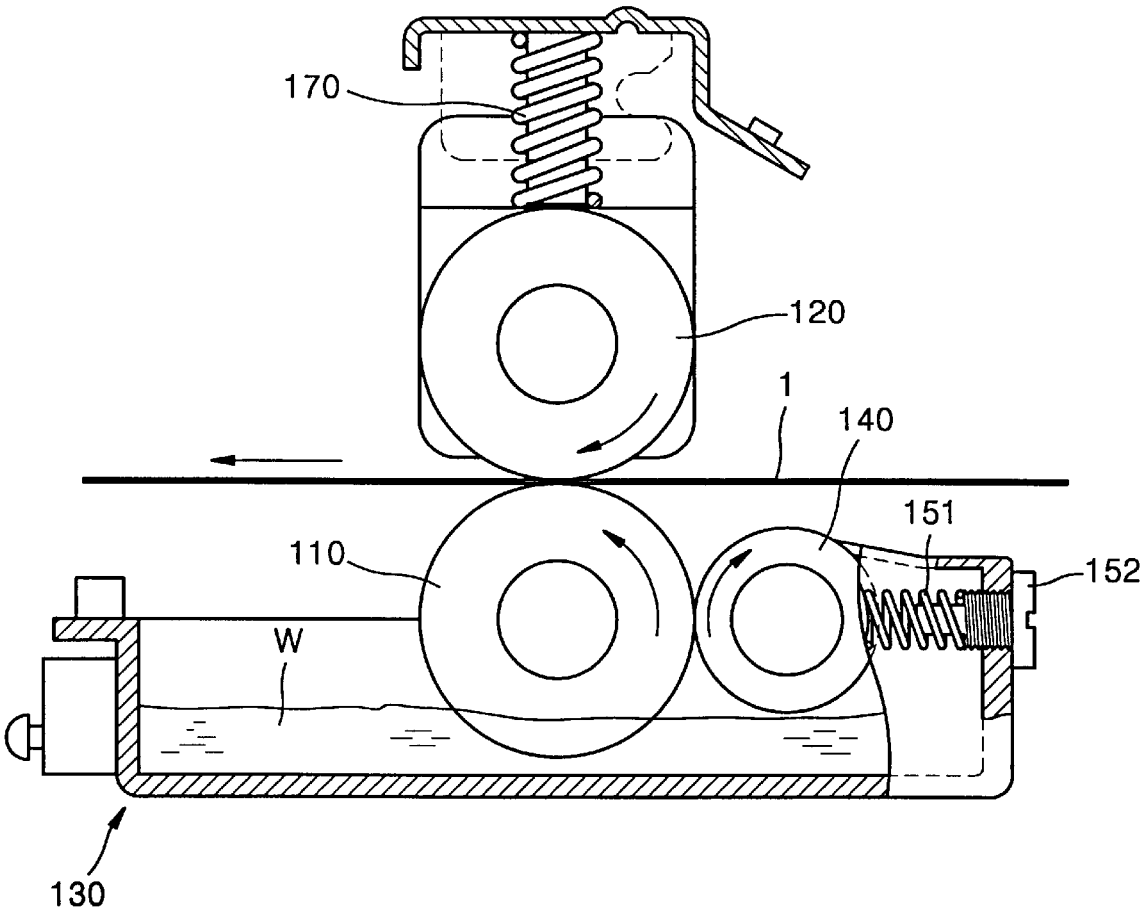
FIG. 3 is a schematic diagram illustrating the internal structure of FIG. 2.
Figure 2:
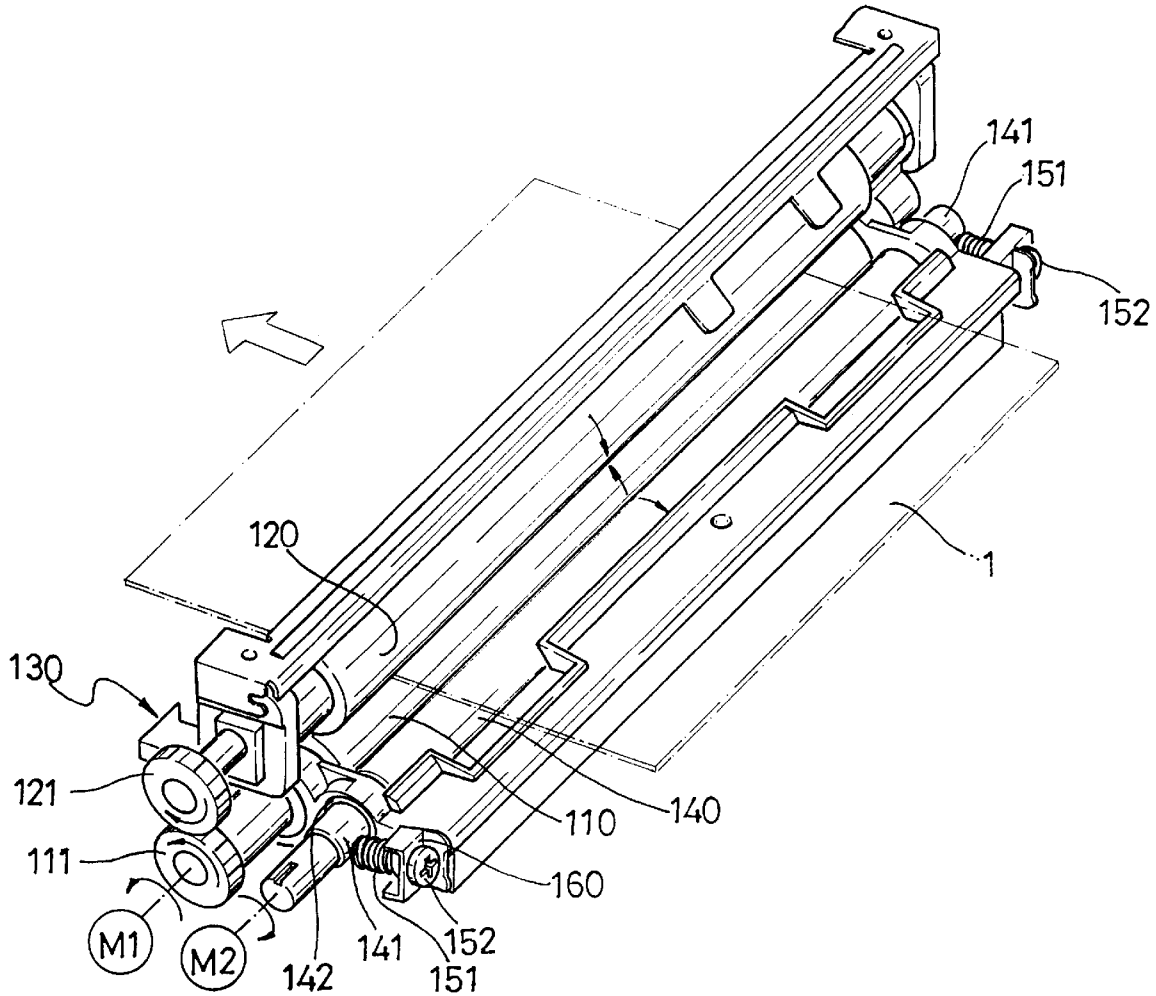
FIG. 2 is a schematic diagram illustrating a sheet coating apparatus according to a first embodiment of the present invention.

FIGS. 2 and 3 illustrate a sheet coating apparatus according to a first embodiment of the present invention.

Referring to the drawings, a coating roller 110 and a backup roller 120 are elastically secured, by a spring 170, to a transfer path through which an image-printed sheet 1 passes, to then be rotated. The coating roller 110 rotates while being partially immersed in a storage tank in which liquid wax W which is a coating liquid is contained. A compression roller 140 securely rotating with the coating roller 110 is installed as a coated amount regulating mechanism. The compression roller 140 squeegees liquid wax W traveling upwards along the outer circumferential surface of the coating roller 110 to adjust the amount of wax coated on the printed surface of the sheet 1. The adjustment can be performed by two factors, that is, a pressing force with respect to the coating roller 110 and a speed ratio. First, the adjustment by the pressing force utilizes the principle that as a pressing force from the compression roller 140 becomes stronger, less wax moves upward toward the sheet 1 along the coating roller 110. In order to adjust the amount of the coated wax, a compression spring 151 for elastically biasing the compression roller 140 in a direction in which the compression roller 140 is securely pressed against the coating roller 110, and a screw 152 for further tightening the compression spring 151 in the direction in which the elastic force is applied or releasing the compression spring 151, are provided at each end of the compression roller 140 as a pressing mechanism. In other words, since the ends of each of the compression springs 151 are in contact with a sill of the corresponding screw 152 and a bearing 141 of the compression roller 140, if the screw 152 is tightened, the force due to the compression spring 151 is increased so that the compression roller 140 presses the coating roller 110 more strongly. Thus, the coated amount is decreased. On the contrary, if the screw 152 is loosened, the coated amount is increased. Reference numeral 142 denotes a sealing member. The compression roller 140 does not actually move a long distance by the pressing mechanism but the pressing force is just increased or decreased in a state in which the compression roller 140 is securely pressed against the coating roller 110. Thus, the sealing member 142 is scarcely deformed. Also, the gap to be sealed is not severely widened.

As shown in FIG. 3, the compression roller 140 is positioned above (and spaced apart from) the pool of liquid wax W. Thus, the compression roller 140 only contacts the liquid wax W that is removed from the pool by the coating roller 110.

Meanwhile, the coated amount can be adjusted by the speed ratio between the two rollers 110 and 140. To this end, the coating roller 110 and the compression roller 140 are connected to two different driving motors M1 and M2 to then be independently driven. The coating roller 110 and the backup roller 120 are connected to gears 111 and 121 to then be linked to each other. In this state, if the rotation speeds of the coating roller 110 and the compression roller 140 are set differently, the compression roller 140 serves to sweep away the wax moving upward along the coating roller 110 by the relative speeds. In particular, if the ratio of the speed of the coating roller 110 to the speed of the compression roller 140 is set to 1:2, the amount of the wax coated on the sheet 1 is reduced to a half compared to the case of the same rotation speed. Thus, the coated amount can be adjusted by regulating the speed ratio in various steps. In order to attain effective coating while suppressing the consumption of wax, a preferable speed ratio is 1:2.

As described above, the amount of wax coated on a printed surface of the sheet 1 can be adjusted by regulating the pressing force and/or ratio of the speed of the coating roller 110 to the speed of the compression roller 140.

Figure 4:
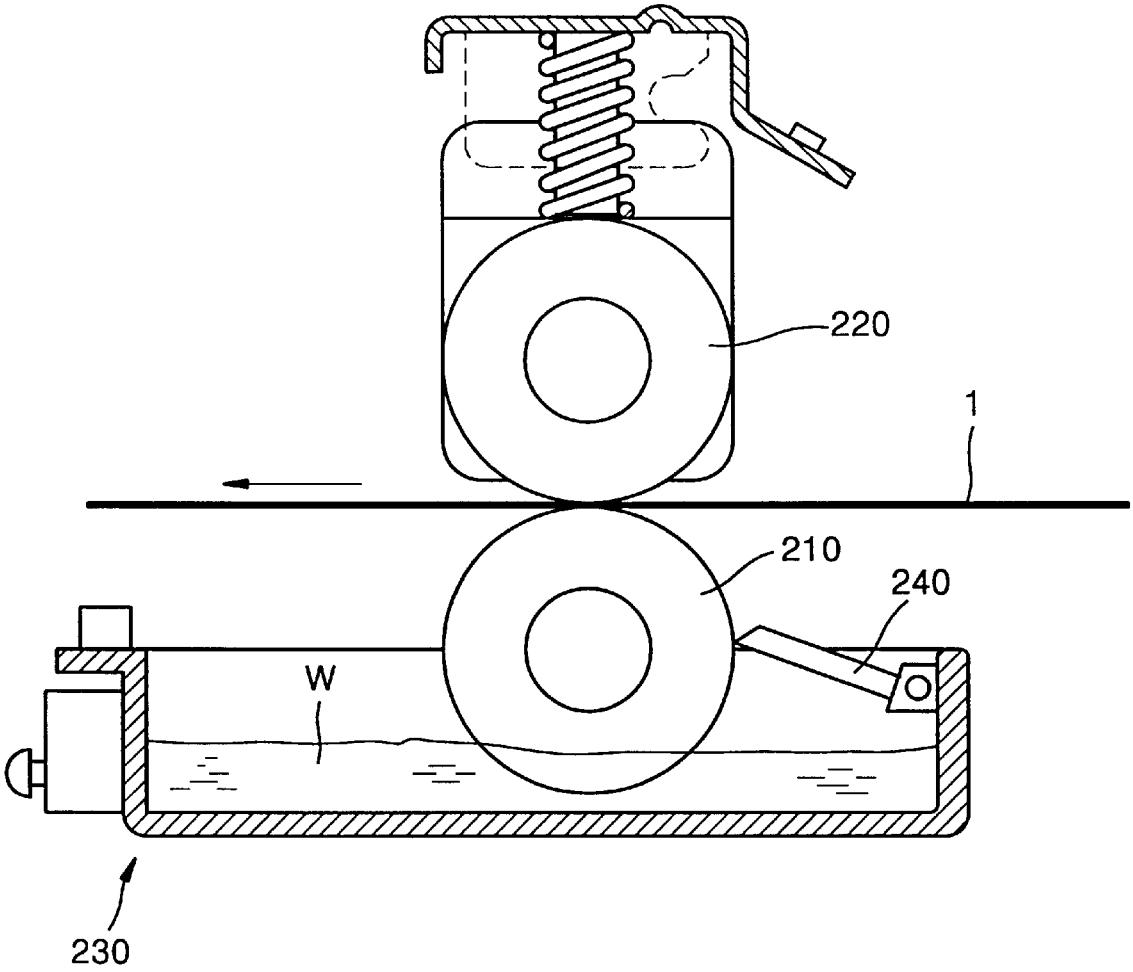
FIG. 4 is a cross-sectional view of a sheet coating apparatus according to a second embodiment of the present invention.

FIG. 4 is a cross-sectional view of a sheet coating apparatus according to a second embodiment of the present invention. In this embodiment, a blade 240 is installed as a coated amount regulating mechanism which adjusts the amount of wax transferred to a coating roller 210, instead of the compression roller (140 of FIG. 2). Thus, some of the liquid wax moving toward the sheet 1 along the coating roller 210 is swept away from the coating roller 210 and into a storage tank 230 by the blade 240 to regulate the coated amount thereof, thereby preventing excess wax from being coated and ensuring a uniform distribution of wax coated on the printed surface of the sheet 1. Reference numeral 220 denotes a backup roller.

As shown in FIG. 4, the blade 240 is positioned above (and spaced apart from) the pool of liquid wax W. Thus, the blade 240 only contacts the liquid wax W that is removed from the pool by the coating roller 210.

Figure 5:
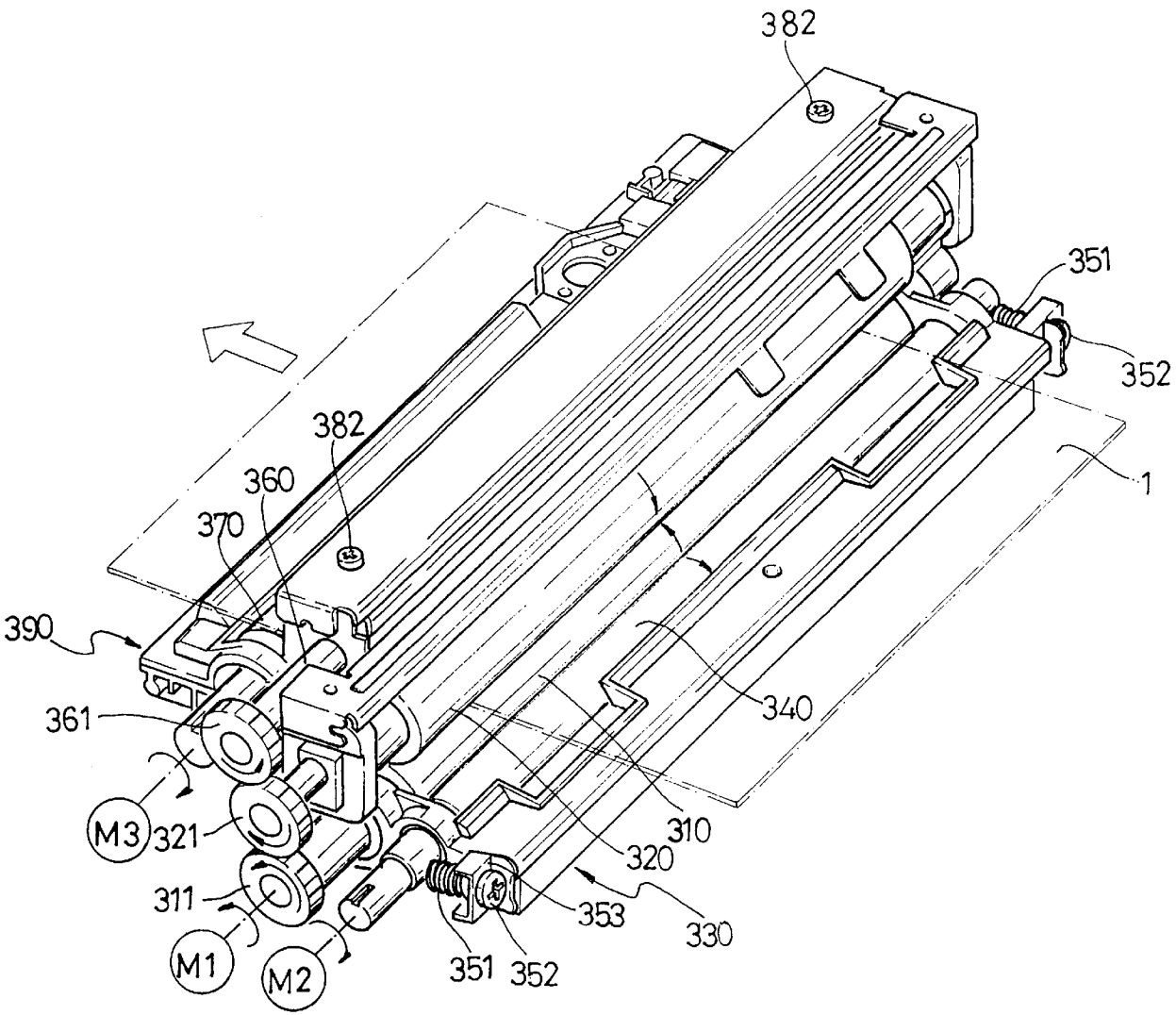
FIG. 5 is a schematic diagram illustrating a sheet coating apparatus according to a third embodiment of the present invention.
Figure 6:
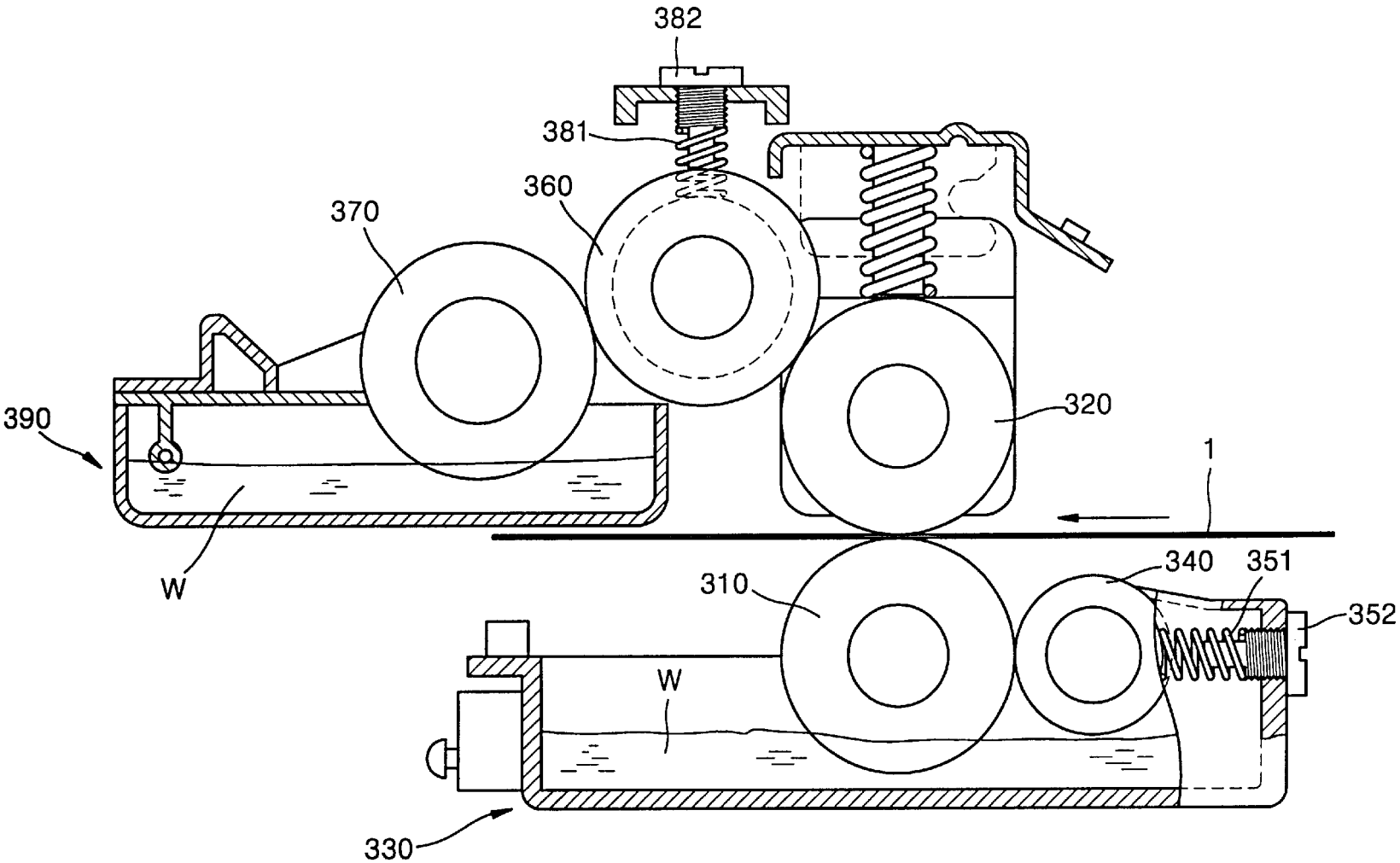
FIG. 6 is a schematic diagram illustrating the internal structure of FIG. 5.

FIGS. 5 and 6 illustrate a sheet coating apparatus according to a third embodiment of the present invention. In this embodiment, first and second coating rollers 310 and 320 are installed as a pair, with the second positioned above the first so as to cope with the case of printing images on both surfaces of a sheet 1. A first storage tank 330, the first coating roller 310, a first compression roller 340, a compression spring 351 and a screw 352, which are installed under the sheet 1, are the same as those in the first embodiment. However, unlike the first coating roller 310, the second coating roller 320 installed on the sheet 1 is not immersed directly into a storage tank in view of its installation position. Thus, a separate feed roller 370 is rotatably installed so as to be immersed in a second storage tank 390. Wax W supplied from the feed roller 370 is transferred to the second coating roller 320 via a second compression roller 360. The second coating roller 320 is connected to the first coating roller by gears 311 and 321 to then be driven. The second compression roller 360 is connected to the second coating roller 320 by gears 321 and 361 to then be driven. In other words, the first and second coating rollers 310 and 320 and the second compression roller 360 are driven by a single motor M1. On the other hand, the feed roller 370 is independently driven by a separate driving motor M3, similar to the first compression roller 340 being driven by the driving motor M2. Thus, the ratio of the speed of the feed roller 370 to the speed of the second compression roller 360 can be varied by increasing or decreasing the speed of the feed roller 370. In this case, the ratio of the speed of the second compression roller 360 to the speed of the feed roller 370 is preferably 1:2, in view of the amount of wax W consumed or coating efficiency. The second compression roller 360 is securely pressed against both the feed roller 370 and the second coating roller 320, and is elastically biased in a direction in which it is securely pressed against the feed roller 370 and the second coating roller 320 by a compression spring 381 and a screw 382 provided at each end of the second compression roller 360. Thus, the pressing force of the second compression roller 360 can be adjusted by tightening or loosening the screws 382. Then, the liquid wax W transferred from the second storage tank 390 along the feed roller 370 is coated on the surface of the sheet 1 via the second compression roller 360 and the second coating roller 320. In this case, the amount of the wax coated on the sheet 1 can be regulated by squeegeeing the liquid wax W by adjusting the ratio of the speed of the feed roller 370 to the speed of the second compression roller 360 and/or adjusting the pressing force of the second compression roller 360, as described above. Also, the wax W can be coated on both surfaces of the sheet 1 in cooperation with the first coating roller 310.

Therefore, the sheet coating apparatus according to the present invention can appropriately adjust the amount of a coating liquid coated on one surface or both surfaces of a sheet.

As described above, the sheet coating apparatus according to the present invention can prevent excess coating liquid from being coated on a sheet by regulating the amount of the coating liquid coated on the sheet, thereby attaining uniform coating.

It is contemplated that numerous modifications may be made to the sheet coating apparatus of the present invention without departing from the spirit and scope of the invention as defined in the following claims.

What is claimed is:

1. A sheet coating apparatus for coating a coating liquid on a surface of a sheet traveling along a predetermined transfer path, comprising:

a storage tank containing a pool of the coating liquid;

a coating roller, which is in contact with the sheet and which is rotatably installed on the transfer path, for coating the coating liquid supplied from the storage tank on the surface of the sheet;

a coated amount regulating mechanism which is pressed against a surface of the coating roller and which regulates an amount of the coating liquid coated on the sheet by squeegeeing the coating liquid sticking on the surface of the coating roller, wherein the coated amount regulating mechanism includes a compression roller; and a pressing mechanism which adjusts the squeegeeing efficiency of the coating liquid by adjusting a pressing force of the compression roller relative to the coating roller, wherein the pressing mechanism includes at least one spring for elastically biasing the compression roller in a direction in which the compression roller is pressed against the coating roller, and at least one screw for tightening or loosening the spring in a direction in which an elastic force is applied.

2. A sheet coating apparatus for coating a coating liquid on both a top surface and a bottom surface of a sheet traveling along a predetermined transfer path, comprising:

first and second storage tanks in which the coating liquid is contained;

first and second coating rollers, which are in contact with the sheet and which are rotatably installed on the transfer path, for coating the coating liquid supplied from the first and second storage tanks respectively on the top and bottom surfaces of the sheet; and first and second coated amount regulating mechanisms securely pressed against surfaces of the first and second coating rollers, respectively, for regulating the amount of the coating liquid coated on the sheet by squeegeeing the coating liquid adhering to the surfaces of the first and second coating rollers, wherein the first storage tank, the first coating roller and the first coated amount regulating mechanism are installed above the transfer path and the second storage tank, the second coating roller and the second coated amount regulating mechanism are installed below the transfer path to simultaneously coat both the top and bottom surfaces of the sheet, wherein one of the first and second coated amount regulating mechanisms includes a feed roller rotatably installed such that the feed roller is partially immersed in a corresponding one of the first and second storage tanks, and a compression roller for squeegeeing the coating liquid adhering to the surface of the feed roller while rotating in a state in which the compression roller is securely pressed against the feed roller and a corresponding one of the first and second coating rollers.

3. The sheet coating apparatus according to claim 2, wherein the compression roller and the feed roller rotate at different speeds.

4. The sheet coating apparatus according to claim 3, wherein the ratio of the speed of the compression roller to the speed of the feed roller is 1:2.

5. The sheet coating apparatus according to claim 2, further comprising a pressing mechanism which adjusting a squeegeeing efficiency of the coating liquid by adjusting a pressing force of the compression roller relative to the corresponding coating roller.

6. The sheet coating apparatus according to claim 5, wherein the pressing mechanism includes a spring for elastically biasing the compression roller in a direction in which the compression roller is securely pressed against the coating roller, and a screw for tightening or loosening the spring in a direction in which an elastic force is applied.

* * * * *